United States Patent [19]

Kajita

[11] 4,273,217

[45] Jun. 16, 1981

[54] WHEELCHAIR LIFT

[75] Inventor: Tosifumi Kajita, Yamato, Japan

[73] Assignee: Marubeni Kogyo K.K., Gunma, Japan

[21] Appl. No.: 48,264

[22] Filed: Jun. 13, 1979

[51] Int. Cl.[3] ..... B66B 9/20

[52] U.S. Cl. ..... 187/9 R; 280/166; 414/480

[58] Field of Search ..... 187/9 R, 10; 280/163, 280/166; 296/62; 414/480, 556, 557

[56] References Cited

U.S. PATENT DOCUMENTS 4,124,096 11/1978 Dudynskyj et al. ..... 187/9 R

*Primary Examiner*—Robert J. Spar

*Assistant Examiner*—Kenneth Noland

*Attorney, Agent, or Firm*—Koda and Androlia

[57] ABSTRACT

The present invention relates to a wheelchair of a bus, which is constructed from plates such as metal sheets connected with hinges and from power supplying devices such as hydraulic cylinders. Some of the power supplying devices work to fold and unfold the plates, and the other power supplying device works to lift up and down the plates. When the plates are folded, they form stairs that enable passengers to easily get on and off the bus. When the plates are unfolded, they form a lift which enables handicapped passengers in wheelchairs to get on and off the bus by the power supplying device.

3 Claims, 4 Drawing Figures

WHEELCHAIR LIFT

BACKGROUND OF THE INVENTION

1. Field of the Invention

This invention relates to a wheelchair lift and more particularly to a wheelchair lift to be attached to a large passenger car such as a bus.

2. Prior Art

In the past, a separate door opening had to be built in a car, such as a bus, in addition to a regular entrance and exit in order to install a lift for handicapped passengers in a wheelchair. This additional door opening takes a significant amount of space in the bus. Besides, an aisle leading to such door opening is required upon sacrifice of some passenger seats.

SUMMARY OF THE INVENTION

Accordingly, it is the primary object of this invention to provide a wheelchair lift which functions as a wheelchair lift for handicapped passengers and also as a step for regular passengers, thereby eliminating the additional door used only for handicapped passengers.

It is another object of this invention to provide a wheelchair lift which is foldable so that there is no projection either inwardly or outwardly.

In keeping with the principles of this invention, the objects are accomplished by a unique structure of a wheelchair lift comprising connecting and step plates, a supporter, and power supplying means.

DETAILED DESCRIPTION OF THE INVENTION

Figure 1:
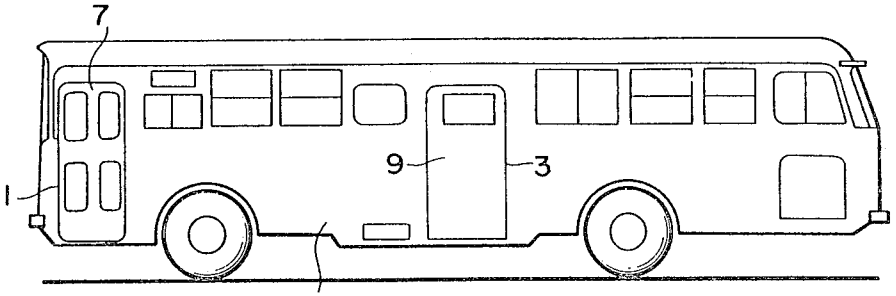
FIG. 1 is a side elevational view of a bus.
Figure 3:
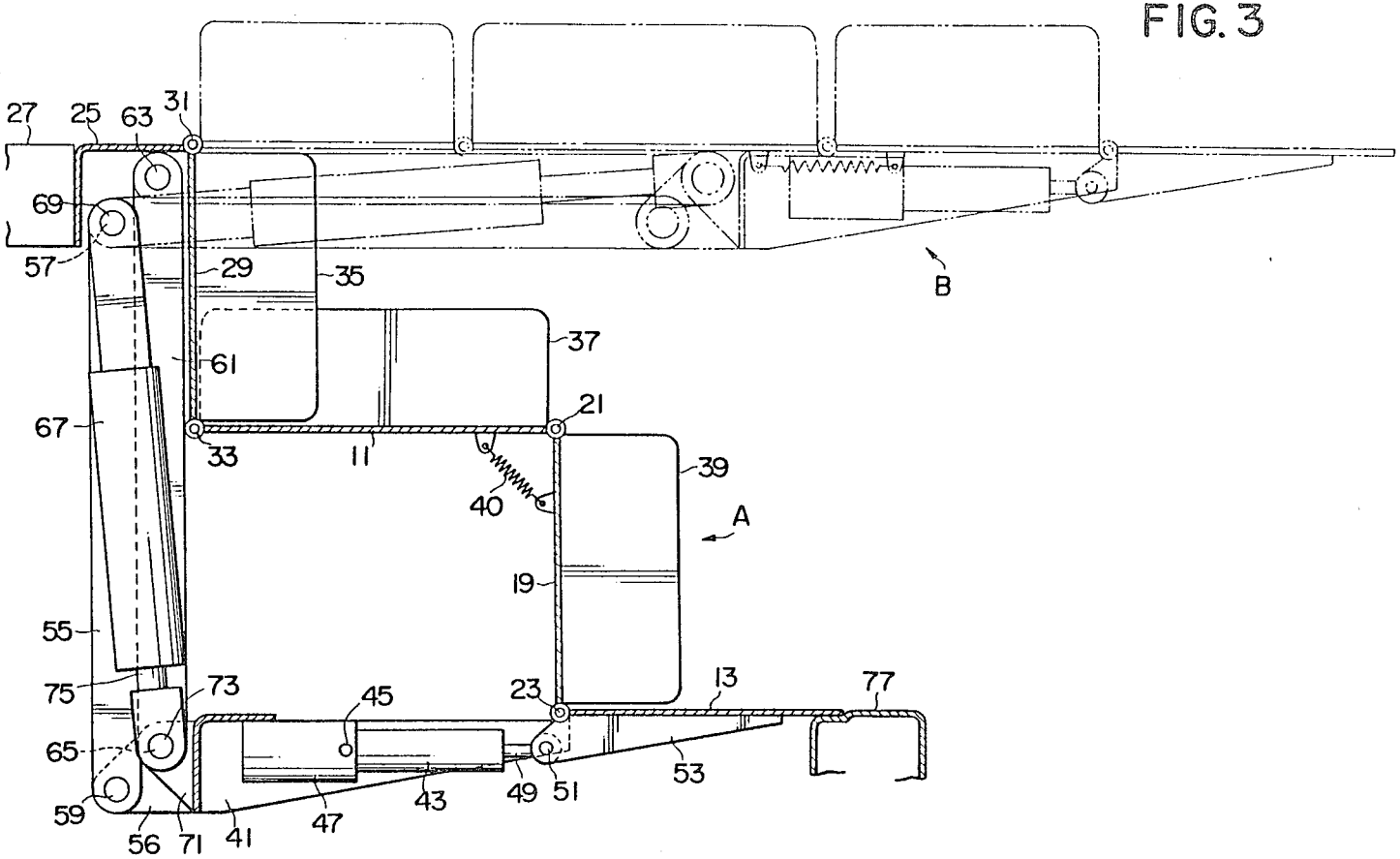
FIG. 3 is a cross sectional view of an embodiment of a wheelchair lift of the present invention used as a step.
Figure 4:
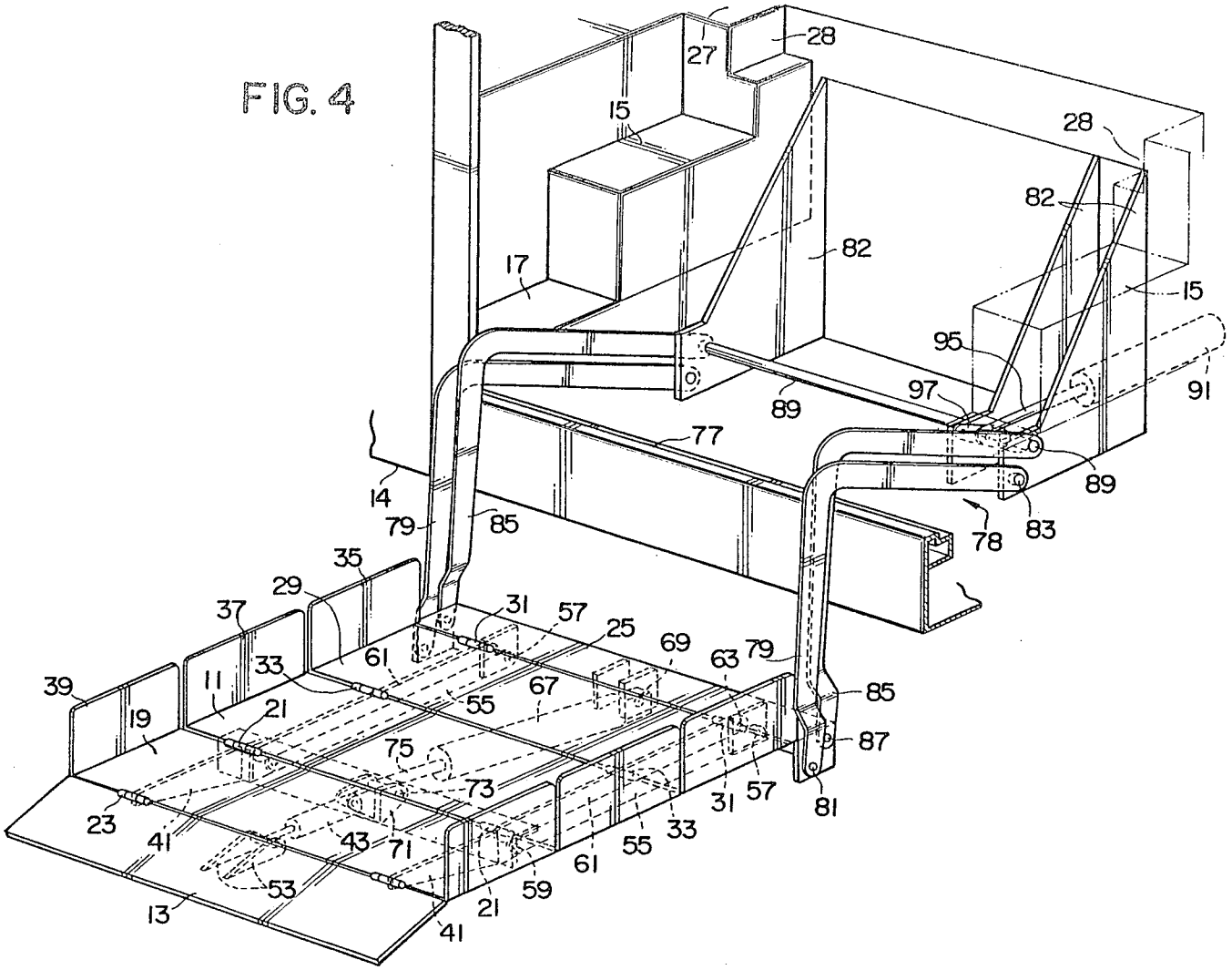
FIG. 4 is a perspective view of an embodiment of a wheelchair lift of the present invention used as a lift.

Referring to FIG. 1, an entrance 1 and an exit 3 are on one side of a bus 5, having doors 7 and 9 for them. In FIG. 3, the end of step sheets 11 and 13 are put on a set of stairs 15 and 17 (see also FIGS. 2 and 4). Both sides of a connecting plate 19 are connected to sides of the step plates 11 and 13 with hinges 21 and 23. The upper face of a supporter 25 is on the same level with floor 27 of the bus 5. The end of the supporter 25 are put on a pair of cut corners made by cutting parts of the floor 27. The sides of a connecting plate 29 are respectively connected to a side of the supporter 25 and a side of the step plate 11 with hinges 31 and 33.

As another embodiment, pairs of stoppers 35, 37, and 39 are respectively mounted on the ends of the connecting plate 29, step plate 11 and connecting plate 19 at right angles to them.

A spring coil 40 is connected to the step plate 11 and the connecting plate 19. One end of a horizontal device 41 is connected to the hinge 23.

As another embodiment, a power supplying device such as a hydraulic cylinder 41 is connected to the horizontal device 41 with a pivot 45 in such a way as to allow rotation and powered by a power generator 47 such as an electric motor. The top end of the piston rod 49 of the power supplying device 43 is freely rotated around a pivot 51 mounted on a bracket 53 connected to the under face of the step plate 13.

It is an alternative to connect the bracket to the horizontal device 41 directly. Also, the top side of the step plate 13 may be bent down in such a manner that a wheelchair can easily get on the plate 13.

Both ends of a link 55 are respectively rotated freely around pivots 57 and 59 mounted on the supporter 25 and the bracket 56 connected to the horizontal device 41. Both ends of a link 61 are respectively rotated freely around pivots 63 and 65 mounted on the supporter 25 and the bracket 56 connected to the horizontal device 41, too. The pivots 57, 59, 63 and 65 are positioned in such a way as to form a parallelogram. In this embodiment, pairs of links 55 and 75 are used. One end of a power supplying device 67 such as a hydraulic cylinder is connected with a pivot 69 to the supporter 25 in such a way as to allow rotation, the other end of which is connected in such a way as to allow rotation with a pivot 73 to a bracket 71 mounted on the horizontal device 41. The top side of the step plate 13 is put on a frame 77 of a part of the bus 5.

Figure 2:
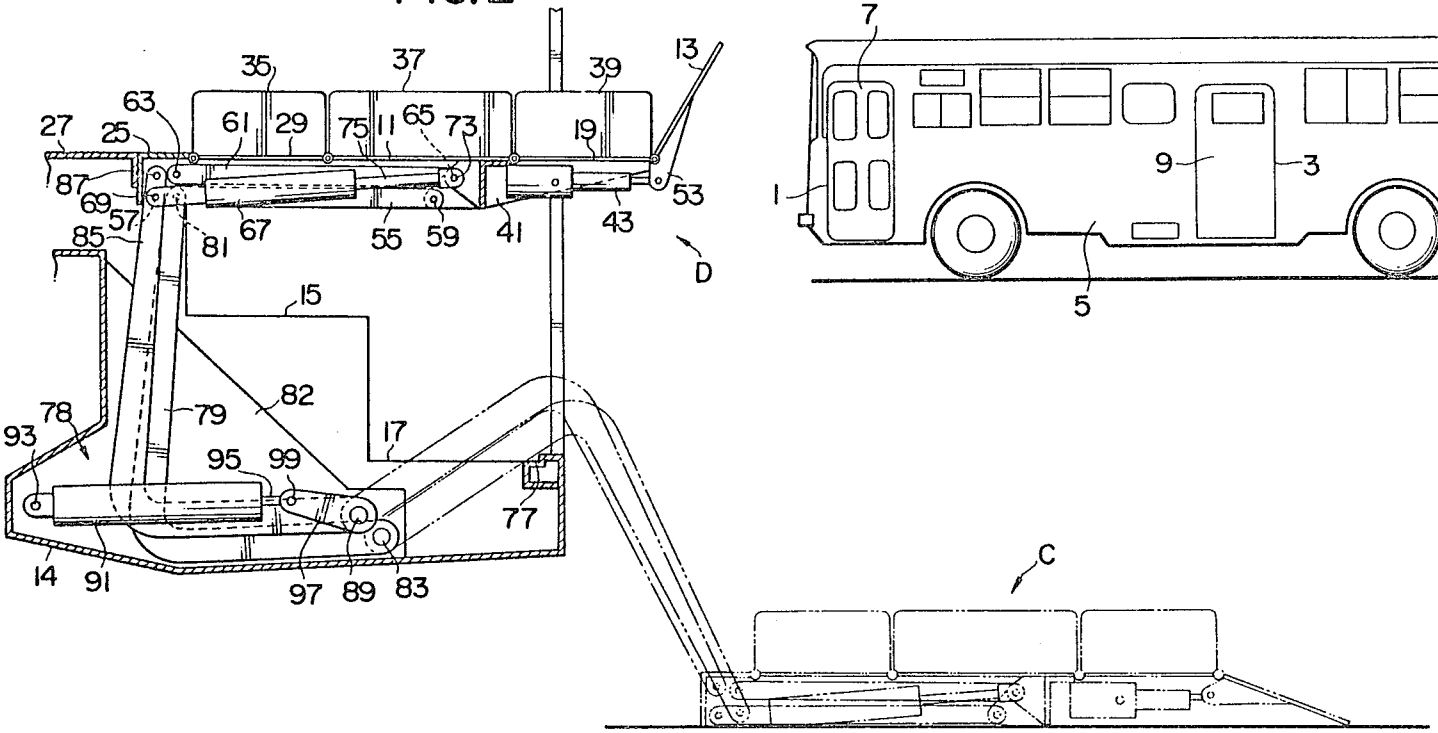
FIG. 2 is a cross sectional view of an embodiment of a wheelchair lift of the present invention used as a lift.

In FIG. 2, a lifting device 78 is constructed as follows:

One end of the lifting link 79 is freely rotated around a pivot 81 mounted on the supporter 25, the other end of which is freely rotated around a pivot 87 mounted on a bracket 82 connected to a part of the bus 5. A lifting link 85 rotates freely around a shaft 83 mounted on the supporter 25. A shaft 89 mounted on the bracket 82 rotates the link 85. The pivots 81 and 87 and the shafts 83 and 89 are positioned in such a way as to form a parallelogram. One end of a power supplying device 91 such as a hydraulic cylinder is connected with a pivot in such a way as to allow rotation. This pivot 93 is mounted on a part of the bus 5. The piston rod 95 of the power supplying device 91 rotates an arm 97 mounted on the shaft 89. In this embodiment, two pairs of lifting links 85 and 79 are employed.

The following is an explanation of how to work the wheelchair lift of the preferred embodiment of the present invention.

As shown in FIG. 3, when a passenger uses it, the step plates 11 and 13 and connecting plates 19 and 29 are positioned as stairs so that the passenger can get up and down the step plates 11 and 13. The links 55 and 61, the power supplying device 91 are put in the space under the step plates 11 and 13 and connecting plates 19 and 29. The sets of the stoppers 35, 37 and 39 are on the outsides of the set of the stairs so that the passenger can step up and down without any obstruction.

When it is used as the wheelchair lift, the stairs indicated to the mark "A" as shown in FIG. 3, forms the lift as described below.

Extending the power supplying device 67 will hold out the links 55 and 61 rotating around the pivots 57 and 63. The horizontal device, therefore, will be lifted up in that state. So the length between the hinges 31 and 23 becomes longer. Then, the connecting plate 29, step plate 11 and connecting plate 19 connected with the hinges 33 and 21 will be extended to form a lift as the drawing indicated by the mark "B" shown in FIG. 3. Then extending the power supplying device will turn the arm 97, which will also turn down the lift B to the ground. Then the step plate 13 will be turned down revolving around the hinge 23 (FIG. 3) by the power supplying device 43 and motor 47. It stops turning down the step plate 13 when the top side of the step plate 13 reached the ground as shown in FIG. 2 (indicated by the mark "C"). After a handicapped passenger in a wheelchair gets on the lift B, constricting the power supplying device 43 will turn up the step plate 13. And constricting the power device 91 will turn up the lifting links 79 and 85, lifting the lift B with the wheelchair up to the position indicated by the mark "D" as shown in FIG. 2, which is the same level with the floor 27 of the bus 5 so that the wheelchair can move to the floor 27.

When a handicapped passenger in a wheelchair gets off the bus 5 as follows, procedure is the reverse of the aforementioned boarding procedure. This is:

When the lift is loaded with a wheelchair, extending the power supplying device 43 will turn up the step plate 13. Then extending the power supplying device 91 will turn down the lifting links 79 and 85 as shown in FIG. 2 (indicated by the mark "C"). Finally, the step plate 13 is turned down so that the wheelchair can get off the lift.

When the wheelchair has gotten on or off the bus, the lift forms stairs as shown in FIG. 3. This is done by:

Constricting the power supplying device 67 will turn out the step plate 13 ("B" in FIG. 3). Then constricting the power device 67 will turn down the links 56 and 61, setting both ends of the step plate 11 on the set of stairs 15 and 15, folding the connecting plate 19 by the spring coil 40 and setting both ends of the step plate 13 on the set of stairs 17 and 17 as shown in FIG. 3 ("A").

In the above mentioned embodiment, the arm 97 is mounted on the shaft 89 and lifting link 85 is turned by the power supplying device 91. It is an alternative to mount the arm 97 on the shaft 83 so that the power device 91 turns the lifting link 79. It can also employ a cover such as canvas, one end of which is connected to the horizontal device 41 or so and the other end of which is rolled up with a reel attached to the bus 5 so that the opening between the lift and the bus 5 is covered with it when the lift gets down to the ground.

I claim:

1. A wheelchair lift for a bus capable of forming stairs for the passenger to use and also capable of forming a lift for the handicapped passenger in a wheelchair, including:

a first connecting plate, a first step plate, a second connecting plate and a second step plate connected together with hinges;

a supporter connected to the first connecting plate with hinges, a set of links one end of which being connected to the supporter and the other end of which being connected to one end of a horizontal device with a set of pivots positioned in such a way as to form a parallelogram, the other end of the horizontal device being connected to a hinge of the second step plate, the supporter being connected to one end of a set of lifting links, and the other end of the set of lifting links being connected to brackets, a shaft also connects the brackets, an arm mounted on one end of the shafts;

a set of stairs for holding both ends of the first and second step plates and which are fixed to the bus;

a first power supplying device for forming the lift when actuated, one end of said first power supplying device being pivotally connected to the supporter the other end of which being pivotally connected to the horizontal device; and a second power supplying device for lowering and lifting the lift, one end of said second power supplying device being pivotally connected to a part of the bus and the other end of which being pivotally connected to the arm.

2. A wheelchair lift as in claim 1 which said first step plate is connected to a bracket connected with a pivot to one end of a third power supplying device the other end of said third power supplying device being connected with a pivot to a bracket mounted on the horizontal device.

3. A wheelchair lift as in claim 1 in which both ends of said first and second step plates and first and second connecting plates have respectively stoppers being at right angles to the plates.

* * * * *